US005676527A

United States Patent [19]

Ogikubo

[11] Patent Number: 5,676,527

[45] Date of Patent: Oct. 14, 1997

[54] AIR PUMP HAVING AN ADJUSTABLE STROKE

[75] Inventor: Takeo Ogikubo, Tokyo, Japan

[73] Assignee: Sibata Scientific Technology Ltd., Tokyo, Japan

[21] Appl. No.: 630,776

[22] Filed: Apr. 10, 1996

[30] Foreign Application Priority Data

Sep. 29, 1995 [JP] Japan ..... 7-274963

[51] Int. Cl.[6] ..... F04B 49/00

[52] U.S. Cl. ..... 417/218; 417/413.1; 92/13

[58] Field of Search ..... 417/218, 221, 417/413.1; 92/13, 13.7

[56] References Cited

U.S. PATENT DOCUMENTS 2,699,119 1/1955 Healey ..... 92/13.7

3,496,874 2/1970 Findlay ..... 417/413.1

4,420,393 12/1983 Smith ..... 417/218

*Primary Examiner*—Charles G. Freay

*Attorney, Agent, or Firm*—Wenderoth, Lind & Ponack

[57] ABSTRACT

An adjustable flow pump, particularly an air pump, utilizing reciprocal movement of a diaphragm movement bar to achieve pumping. The stroke of the reciprocating diaphragm movement bar can be adjusted without stopping operation of the pump. The diaphragm movement bar is mounted on a pump main body and a swing member is operably coupled to a rotary output shaft of a motor. The rotary output shaft is connected to a cam which imparts motion to the swing member. The movement of the swing member is transmitted, by a linking member, to the reciprocating diaphragm movement bar which then moves along a linear guide. The stroke of the diaphragm movement bar is adjusted by a linear motion mechanism which is operable to change the position of the swing member relative to the diaphragm movement bar.

11 Claims, 5 Drawing Sheets

AIR PUMP HAVING AN ADJUSTABLE STROKE

BACKGROUND OF THE INVENTION

The present invention relates to a pump utilizing a reciprocal movement and, in particular, an adjustable air pump that controls the flow rate by varying the length of the stroke of a reciprocating member which engages and moves a pump diaphragm.

A conventional diaphragm air pump structure is shown in FIG. 5. The illustrated pump includes a cam 42 connected to a shaft 41 of a motor 40 and a diaphragm 43 connected to a member, such as a transmission bar 44. The fixed stroke of diaphragm 43 is determined by the configuration of cam 42. Another known diaphragm air pump structure is shown in FIG. 6. The pump structure includes a cam 47 connected to a shaft 46 of a motor 45 and a diaphragm 48 which is connected to opposite ends of a C-shaped lever 49. The stroke of the diaphragm 48 is adjusted by changing the position of a rotation support shaft 50 along an elongated slot or hole 51 as shown in FIG. 6.

The flow rate of the pump illustrated in FIG. 5 is adjusted by using a throttle valve or by varying the rotation speed of the direct current motor. In the pump illustrated in FIG. 6, the flow rate can be adjusted by changing the position of the rotation support shaft 50 of lever 49. This type of pump does have a range of flow rates. However, changing the rate of flow requires stopping the motor 45 and discontinuing pump operation in order to change the position of rotation support shaft 50.

For the following reasons it is not cost effective or practical to utilize the pump shown in FIG. 5 in an environment where it is necessary to vary the flow rate of the pump. Varying the flow rate of a pump by the use of a throttle valve creates an unnecessary load on the diaphragm. The additional load creates an increase of motor noise and vibration and an excessive consumption of electrical power. Particularly, in designing a battery powered portable air sampling pump for open air or personal use, the power consumption is a matter of paramount importance and must be minimized since the battery capacity determines the duration, size, weight, etc. of the portable pump.

As noted above, the flow rate of the pump shown is FIG. 5 can also be adjusted by changing the rotational speed of the motor. However, in the low flow range, due to the low rotational speed of the motor, there is increased pulsation of the flow and lower suction and discharge pressure which are detrimental to pump operation. Therefore, the pump shown in FIG. 5 is practical only for a given flow rate and in order to provide different flow rates it would be necessary to provide several pumps, each having a different capacity.

With regard to the pump shown in FIG. 6, although the flow rate can be adjusted without changing the motor speed or adding a throttle valve, the entire pump operation must be stopped in order to change the flow rate by changing the position of the rotation support shaft. Accordingly, this type of pump would not be suitable for applications where continuous use and flow rate adjustment are necessary.

A vibrating diaphragm pump utilizes a different operating principle. Since it is driven by the repulsion force of a magnet, it exhibits less stability with regard to pressure than a pump employing a cam, and therefore is not suitable for applications requiring operation times longer than eight hours.

SUMMARY OF THE INVENTION

The objective of the present invention is to provide an economical and all purpose adjustable stroke pump, particularly an air pump, that solves the problems of conventional pumps. A further objective of the present invention is to provide such a pump in which flow rates can be varied without the necessity of stopping the pumping operation. Such a pump has a range of flow rates. Therefore, the number of different pumps necessary is reduced. Also, a reduction of pulsation in the low flow rate range and efficient power consumption will be realized due to the constant speed of motor rotation.

In order to achieve the above mentioned objectives, the present invention includes a motor having an output shaft coupled to a cam which rotates upon actuation of the motor. The cam is engaged with a swing member which pivots upon rotation of the cam thereby imparting reciprocal motion to a diaphragm movement bar which is connected to the swing member via a linking member.

In order to vary the stroke range of the reciprocating diaphragm movement bar, the position of the rotary motor is changed by moving a base on which the motor is supported. This movement of the base is effected by a linear movement mechanism. Such positioning of the motor can be accomplished without interrupting a pumping operation.

BRIEF DESCRIPTION OF THE DRAWINGS

Other features and objects of the invention will become apparent from the following detailed description, taken in conjunction with the accompanying drawings, which illustrate, by way of example, the features of the invention.

DETAILED DESCRIPTION OF THE INVENTION

Figure 1:
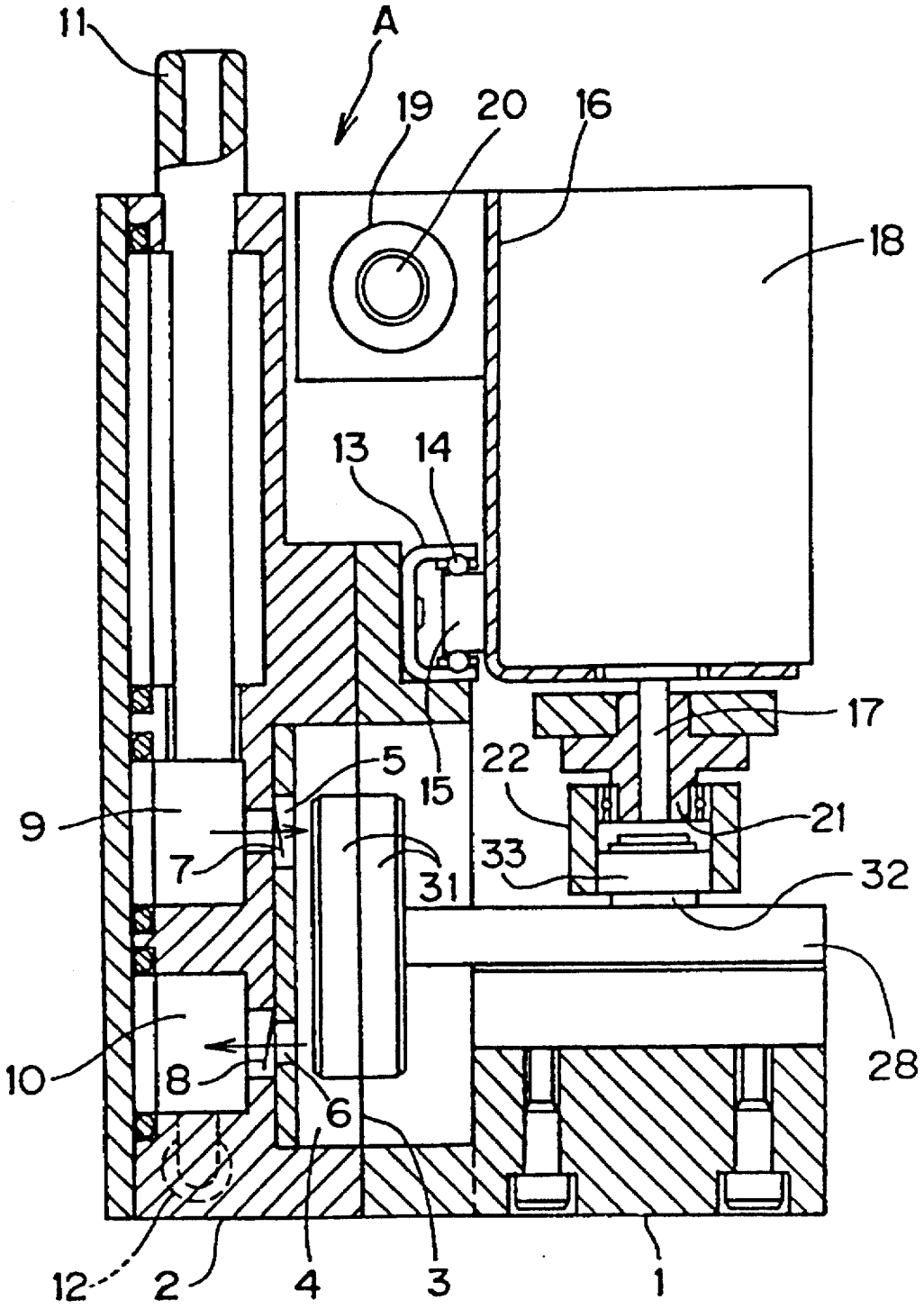
FIG. 1 is a cross-sectional view of an embodiment of an adjustable air pump according to the present invention.
Figure 2:
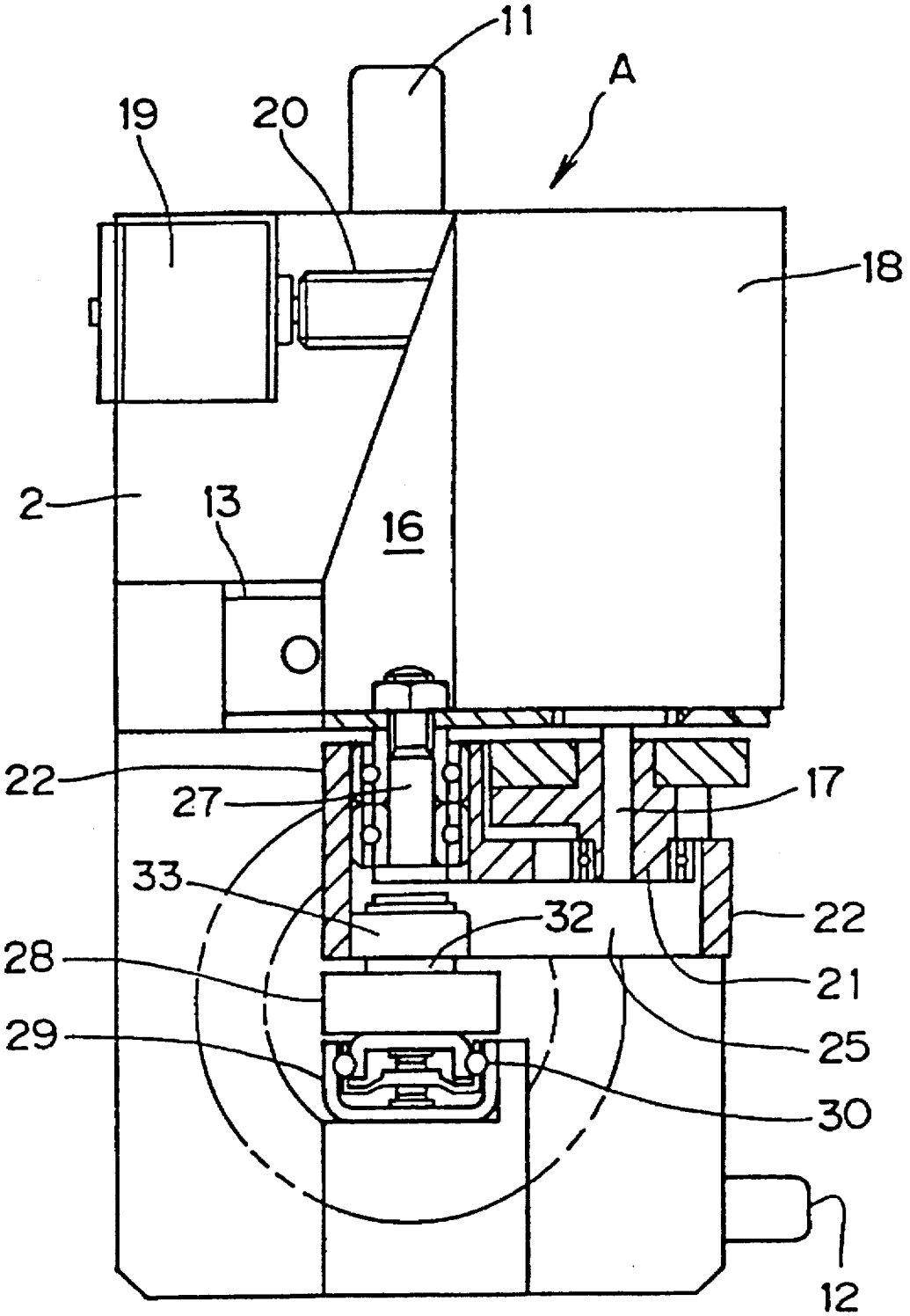
FIG. 2 is a partial cross-sectional front view of the adjustable air pump at a position where the stroke range of a diaphragm movement bar relative to a swing member is zero.
Figure 3:
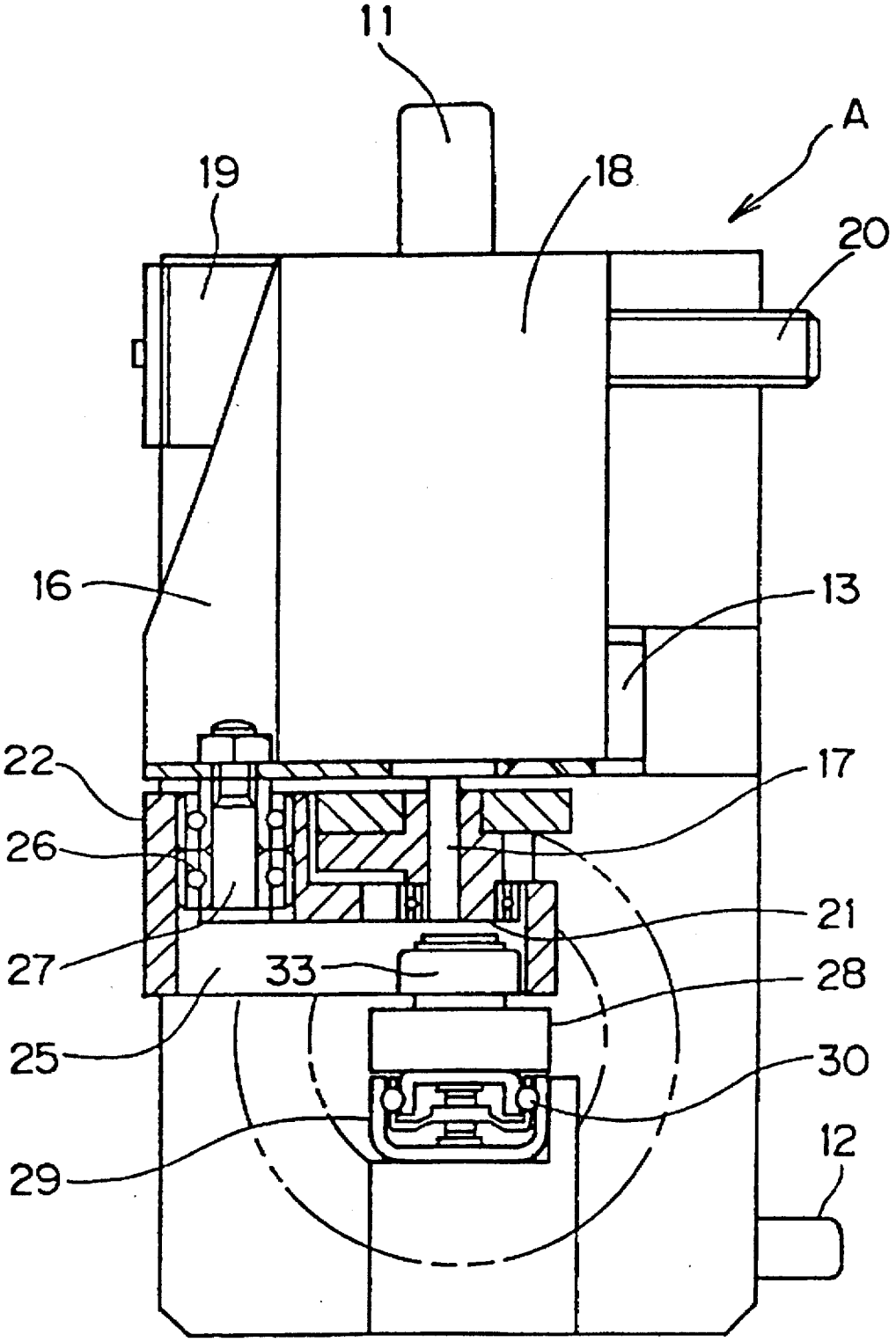
FIG. 3 is a partial cross-sectional front view of the adjustable air pump at a position of maximum stroke.

With reference to FIGS. 1–3, a pumping element or diaphragm 3 is fixed at an interface of a pump main body 1 and a valve block 2 of an adjustable stroke air pump A. A suction chamber 9 and an exhaust chamber 10 are formed in the valve block 2 and communicate with a pump chamber 4 via a suction hole 5 and an exhaust hole 6, respectively. One way check valves 7, 8 are provided in holes 5, 6 respectively. Also, an inlet conduit 11 communicates with the suction chamber 9 and an outlet conduit 12 communicates with the exhaust chamber 10.

The pump diaphragm 3 is connected to one end of a reciprocating diaphragm movement bar 28 by means of a diaphragm connector 31. The diaphragm movement bar 28 is mounted for linear movement along a guide rail 29 via ball bearings 30.

Extending from the diaphragm movement bar 28 is a linking member 32. The linking member 32 includes a shaft or rod, fixed at one end to the upper surface of the diaphragm movement bar 28, and a rotatable ring 33 which is connected to the opposite end of the shaft or rod via ball bearings (not shown in figures). A swing motion mechanism is provided for moving the diaphragm movement bar 28. The swing motion mechanism includes a cam 21 and a swing member 22. The swing member 22 is provided at one end with a through hole 23 and at the other end with a through hole 24 (FIGS. 4*a*–4*d*). The swing member 22 further includes a cam groove or slot 25. The cam groove or slot 25 extends between an outer periphery of through hole 23 and an outer periphery of through hole 24. In the assembled stake, a peripheral annular surface of the rotatable ring 33 of linking member 22 is engaged with the cam groove or slot 25 and the cam 21 engages through hole 24.

A linear motion mechanism is provided to vary the position of the swing member 22. The linear motion mechanism includes a guide rail 13, connected to the pump main body 1, and a slider 15, movably supported by the guide rail 13 via ball bearing 14. The guide rail 13 extends orthogonally to the guide rail 29 and the diaphragm movement bar 28. The slider 15 is fixed to a lower side of a base 16 which supports a motor 18. The motor 18 includes a rotary output shaft 17 coupled with cam 21.

A motor 19, such as a stepping motor, is fixed to the pump main body 1 and is operatively connected to the upper side of the base 16. The motor 19 includes a rotary output shaft 20. The output shaft 20 is threaded to engage a portion or flange of base 16. Linear movement of the base 16 along the guide rail 13 is effected by means of the stepping motor 19.

Also, the swing member 22 is rotatably connected with a bottom portion of the base 16 by means of a shaft 27. The shaft 27 is fixed to the base and extends into through hole 23 of swing member 22 via ball bearings 26.

Figure 4A:
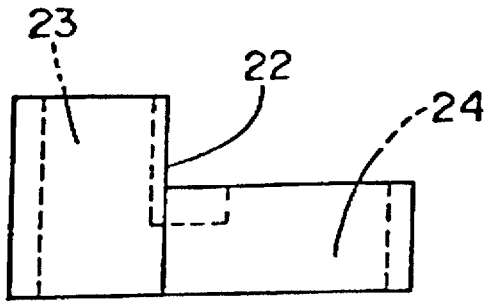
FIG. 4*a* is a front view of the swing member.
Figure 4B:
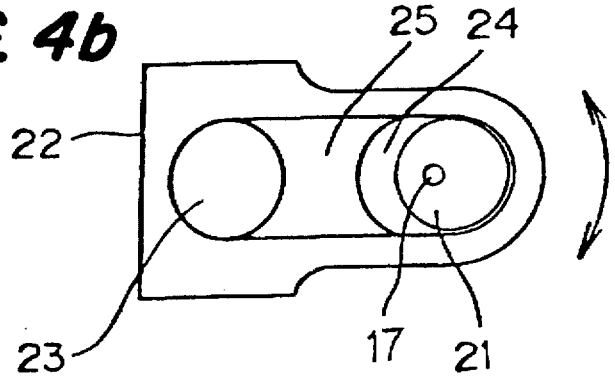
FIG. 4*b* is a bottom view of the swing member and cam.
Figure 4C:
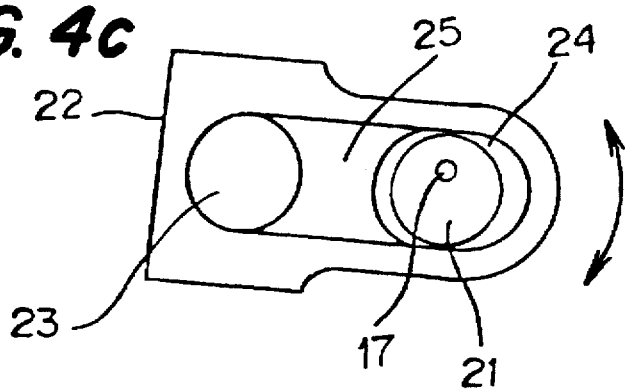
FIG. 4*c* is a bottom view of the swing member in a deflected position.
Figure 4D:
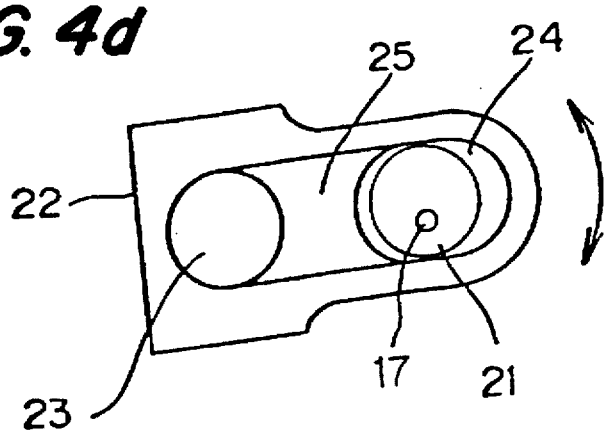
FIG. 4*d* is a bottom view of the swing member deflected in a direction opposite to that shown in FIG. 4*c*.
Figure 5:
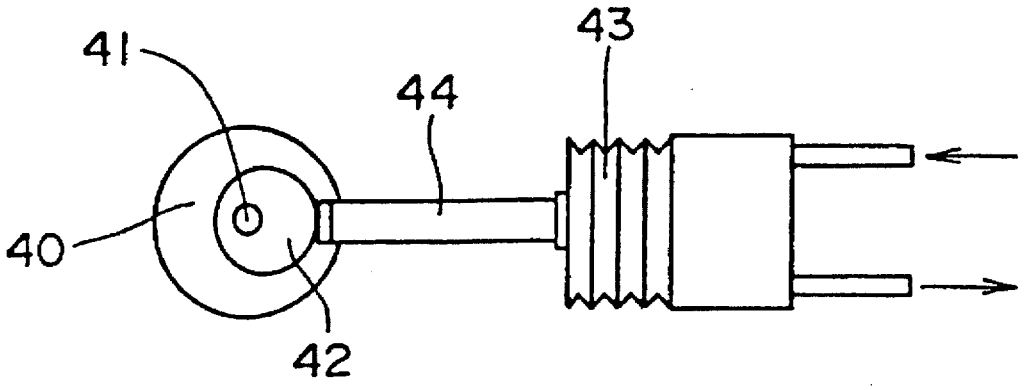
FIG. 5 PRIOR ART
FIG. 5 is a schematic view of a prior art air pump.
Figure 6:
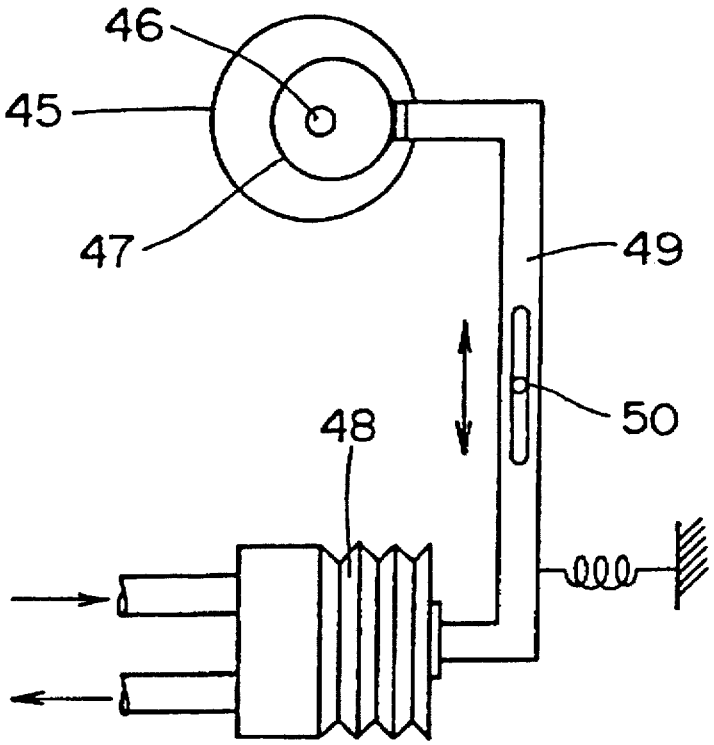
FIG. 6 PRIOR ART
FIG. 6 is schematic view of another prior art air pump.

The cam groove 25 extends across the axis of the shaft 17 of motor 18 and the axis of the shaft The cam 21, best shown in FIG. 3, may take any number of forms. For example, the cam 21 may be an eccentric disc, the design of which will dictate the amount and quality of motion imparted to the reciprocating bar 28. The function of the cam 21, in conjunction with the swing member 22 as seen in FIGS. 4*b*–4*d*, is to convert rotary motion of the output shaft 17 into the linear motion of the reciprocating diaphragm movement bar 28.

Due to the eccentricity, the cam 21 alternately engages opposing sides of the through hole 24 and deflects the swing member 22 in opposite directions (FIGS. 4*c*, 4*d*) about the shaft 27. The pivoting motion of the swing member 22 is in turn transmitted to the diaphragm movement bar 28 by means of the linking member 32.

The length of the stroke of the diaphragm movement bar 28 is determined by the position of the linking member 32 relative to the cam groove 25. The cam groove 25 is positioned relative to the linking member 32 by moving the base 16 upon which the motor 18 is supported. As noted above, the base 16 moved by the stepping motor 19 along the guide rail 13 to change the position of the swing member 22 relative to the linking member 32.

The relative positions vary between 1) a "zero position" (FIG. 2) at which the fixed shaft 27 is aligned with the shaft of the linking member 32 and 2) a "maximum movement position" (FIG. 3) at which the linking member 32 is positioned at the end of the cam groove 25 remote from the pivoting point of the swing member 22.

In the zero position, the linking member 32 is located directly below the pivot point of the swing member 22. Therefore, the swing member 22 will not impart any motion to the diaphragm movement bar 28. Further, in this embodiment, the length of the maximum stroke of the diaphragm movement bar 28 occurs at the maximum movement position. The stroke is a function of the maximum deviation of the cam 21, as measured from the axis of rotation thereof. In the maximum movement position, the stroke is at a maximum because the linking member 32 is located at the furthest possible distance away from the pivot point of the swing member 22, i.e. near the axis of the shaft 17.

The operation of the pump will now be described.

Initially, the suction and exhaust volumes are set, and then the motor 18 is actuated. As the motor 18 rotates, the swing member 22 pivots about the fixed shaft 27 due to the rotation of cam 21 in through hole 24. The pivoting motion of the swing member 22 is transmitted to the diaphragm movement bar 28 via linking member 32 which is engaged in cam groove or slot 25. As the swing member pivots, the rotary motion of the cam 21 (FIGS. 4*b*–4*d*) is converted to the linear reciprocating motion of the diaphragm movement bar 28.

The linear motion of the diaphragm movement bar 28 causes the diaphragm 3 to move between extended and retracted positions. As the diaphragm is retracted, a low pressure area is created in the pump chamber 4 causing the one-way check valve 7 to open and allow air from the air inlet 11 to flow into the pump chamber 4 via suction chamber 9. When the diaphragm 3 is moved in the opposite direction, to the extended position, the air in pump chamber 4 is pressurized, causing the one-way check valve 8 to open and allow the air to be exhausted through outlet 12 via exhaust chamber 10.

In this embodiment, the stroke length of the diaphragm movement bar is a function of the maximum deviation dimension of cam 21. As described above, the maximum stroke length corresponds to the situation where the swing member 22 is moved to the positon shown in FIG. 3. It will be readily apparent to one of ordinary skill in the art that the range of the stroke length is determined by the range of motion of the base 16 and the length of cam groove or slot 25.

The degree of adjustment precision of the flow rate is substantially improved by selecting the range of motion of the base to be more than ten times the maximum deviation dimension of cam 21. It should also be understood that the positioning of the base 16 can be accomplished manually and that the movement transmission mechanism described above can be used with pumps other than diaphragm air pumps.

The present invention as described above provides the following advantages:

The optimal stroke of the diaphragm movement bar 28 can be selected during continuous pump operation without the necessity of stopping the motor 18.

By using a flow sensor, the stroke of the diaphragm movement bar can be automatically controlled. The number and types of pumps needed for a particular application is reduced because of the increased constant flow rate range of the pump of the present invention, thus resulting in substantial cost savings.

By programming the stroke of the diaphragm movement bar, several types of breathing patterns, such as in artificial heart and lung machines, can be controlled by a single pump.

Since the rotational motor speed of this type of pump is constant for both high and low flow rates, pulsation in the low flow rate range is reduced, resulting in a substantial reduction of power consumption.

During manufacture of the swing member, both the through holes and the cam groove or slot are drilled simultaneously. Therefore, the "zero position" of an associated diaphragm movement mechanism is automatically determined. Also, normal manufacturing accuracy is acceptable because precise alignment of separate parts is not required in assembling the apparatus. This leads to substantial cost savings during manufacture.

Although the present invention has been fully described by way of examples with reference to the accompanying drawings, various changes and modifications will be apparent to those skilled in the art. Therefore, unless such changes and modifications otherwise depart from the spirit and scope of the present invention, they should be construed as being encompassed by the following appended claims.

I claim:

1. A pump comprising:

a pump body;

a pump element positioned in said pump body for pumping;

a reciprocating bar having a first end connected to said pump element;

a base mounted for movement along said pump body;

a first drive motor supported on said base and having a rotary output shaft;

a cam positioned on said rotary output shaft of said first drive motor to rotate therewith;

a swing member having a first end pivotally mounted on said base and a second end operatively engaging said cam; and a linking member having a first end fixed on said reciprocating bar and a second end operatively engaging said swing member, wherein said swing member can be moved relative to said linking member by moving said base along said pump body to adjust the movement of said reciprocating bar.

2. The pump as claimed in claim 1, further comprising a second motor mounted on said pump body and operatively engaged with said base for effecting movement thereof.

3. The pump as claimed in claim 2, wherein said second motor comprises a stepping motor having a threaded rotary output shaft operatively engaged with said base.

4. The pump as claimed in claim 1, wherein said pivotal connection between said first end of said swing member and said base includes a through hole formed in said first end of said swing member and a shaft fixed on said base and rotatably engaging said through hole so as to allow said swing member to pivot about said shaft.

5. The pump as claimed in claim 4, wherein said fixed shaft, said first motor output shaft and said linking member have substantially parallel longitudinal axes and wherein movement of said reciprocating bar ranges from a zero position in which said axis of said fixed shaft is aligned with said axis of said linking member and a maximum movement position in which the linking member is positioned at said second end of said swing member opposite said fixed shaft.

6. The pump as claimed in claim 1, wherein said swing member comprises:

an upstanding member, at said first end, having a first bore rotatably receiving a shaft fixed on said base;

a second bore, in said second end, engaging said cam; and an elongated slot formed in said swing member and engaging said linking member.

7. The pump as claimed in claim 6, wherein said elongated slot extends between an outer periphery of said first bore and an outer periphery of said second bore.

8. The pump as claimed in claim 6, wherein said linking member comprises:

a rod having a first end fixed to said reciprocating bar and and a second end; and a ring rotatably mounted on said rod at said second end thereof and having a peripheral surface engaging said elongated slot of said swing member.

9. The pump as claimed in claim 1, further comprising a guide rail fixed on said pump body, said base being guided for linear movement along said guide rail.

10. The pump as claimed in claim 1, further comprising a guide rail connected to said pump body, said reciprocating bar being guided for linear movement along said guide rail.

11. The pump as claimed in claim 1, wherein said pumping element is a diaphragm.

* * * * *